US007226491B2

(12) United States Patent
Choi

(10) Patent No.: US 7,226,491 B2
(45) Date of Patent: Jun. 5, 2007

(54) AIR PURIFYING SYSTEM AND METHOD FOR DIAGNOSING MALFUNCTION THEREOF

(75) Inventor: Sung Mu Choi, Seongnam (KR)

(73) Assignee: Hyundai Motor Company, Seoul (KR)

( * ) Notice: Subject to any disclaimer, the term of this patent is extended or adjusted under 35 U.S.C. 154(b) by 270 days.

(21) Appl. No.: 11/023,679

(22) Filed: Dec. 27, 2004

(65) Prior Publication Data

US 2005/0193799 A1 Sep. 8, 2005

(30) Foreign Application Priority Data

Jun. 3, 2004 (KR) ..... 10-2004-0040413

(51) Int. Cl.
*G01M 15/00* (2006.01)

(52) U.S. Cl. ..... 71/118.1

(58) Field of Classification Search ..... 73/118.1, 73/865.9, 865.8, 1.01, 1.08; 374/141, 142, 374/144, 145, 208; 165/11.1, 148, 207, 302; 96/414, 417–421, 423; 62/473, 478, 498–511
See application file for complete search history.

(56) References Cited

U.S. PATENT DOCUMENTS 6,248,067 B1 * 6/2001 Causey et al. ..... 600/365
6,681,619 B2 * 1/2004 Alleving et al. ..... 73/118.1

FOREIGN PATENT DOCUMENTS

JP 2001-347829 12/2001

* cited by examiner

*Primary Examiner*—Robert Raevis
(74) *Attorney, Agent, or Firm*—Morgan Lewis & Bockius LLP

(57) ABSTRACT

The air purifying system and a method for diagnosing malfunction thereof includes a heat dissipation part provided with an air purifier, an OBD sensor permanently fixed to the heat dissipation part, and an electronic control unit (ECU) electrically connected with the OBD sensor in order to determine whether the OBD sensor is fixed to the heat dissipation part.

15 Claims, 3 Drawing Sheets

AIR PURIFYING SYSTEM AND METHOD FOR DIAGNOSING MALFUNCTION THEREOF

CROSS-REFERENCE TO RELATED APPLICATIONS

This application claims priority to Korean application no. 10-2004-0040413, filed on Jun. 3, 2004, the disclosure of which is incorporated herein by reference.

FIELD OF THE INVENTION

The present invention relates to an air purifier. More particularly, the present invention relates to an air purifying system and a method for diagnosing malfunction thereof.

BACKGROUND OF THE INVENTION

Generally, an air purifier may be an ozonolysis material coated on a radiator, in order to change ozone of the atmosphere into oxygen. In addition, an air purifying system includes the air purifier and an on-board diagnosis (OBD) sensor, and determines whether the air purifier is operating normally.

Presently, there are direct type OBD sensors and indirect type OBD sensors. First, the direct type OBD sensor is an ozone sensor for directly detecting an ozone density of the radiator. The ozone sensor must have good precision in order to detect the ozone density (0~200 ppb) in the atmosphere, and durability in order to interrupt a failure generated by a foreign substance of the atmosphere. Particularly, the ozone sensor must have a high precision in order to detect the ozone density lower than 200 ppb.

However, since the ozone sensor must have a high precision, such sensors are expensive. In addition, the ozone sensor must maintain a fixed moisture, temperature, etc., because the ozone sensor is affected by moisture, temperature, etc. However, since the ozone sensor must be provided with many elements in order to maintain a fixed moisture, temperature, etc., the sensor is even more expensive.

On the other hand, the indirect type OBD sensor detects an electrical resistance of the ozonolysis material, and detects a coated thickness of the ozonolysis material through the detected electrical resistance. A method for detecting the electrical resistance uses a printed circuit board (PCB) on which the ozonolysis material is coated. That is, the method detects an electrical resistance of the ozonolysis material by supplying an electric current to the PCB. However, since an adhesion between the radiator (aluminum ware) and the ozonolysis material is different from an adhesion between the PCB (epoxy ware) and the ozonolysis material, a problem occurs in that there is a difference between a coated thickness on the PCB and a coated thickness on the radiator.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

The present invention provides an air purifying system and a method for diagnosing malfunction thereof having non-limiting advantages of checking easily and perfectly whether an air purifier is normally operated.

An exemplary air purifying system according to an embodiment of the present invention includes: a heat dissipation part provided with an air purifier; an OBD sensor irremovably or permanently fixed to the heat dissipation part; and an electronic control unit (ECU) electrically connected with the OBD sensor in order to determine whether the OBD sensor is fixed to the heat dissipation part. By permanently, it is meant that the sensor is not intended to be removed.

In a further embodiment according to the present invention, the heat dissipation part includes a radiator cooling an engine of a vehicle. In another further embodiment according to the present invention, the heat dissipation part includes a condenser for an air conditioner. In another further embodiment according to the present invention, the OBD sensor is fixed to a coolant tank which makes up a bottom portion of the radiator.

In another further embodiment according to the present invention, the OBD sensor includes: a body permanently fixed to the coolant tank; a communication chip incorporated in the body and communicating with the ECU in an early state of an engine operation; and a thermocouple provided to the body and detecting a temperature of coolant in the coolant tank.

In another further embodiment according to the present invention, the air purifying system further includes a fixing part for fixing permanently the OBD sensor to the heat dissipation part, wherein the fixing part includes: a male connector formed at an outer-circumference of the body; and a female connector formed at a predetermined portion of the coolant tank in order for the male connector to be coupled thereto. The male connector includes: an insert portion tapered toward an insertion direction of the body; and an indentation formed at a start point of the insert portion and indented toward the insertion direction. The female connector includes: a guide portion having a rib defining an insertion hole into which the insert portion of the male connector is inserted; and a protrusion formed at an inner-circumference of the guide portion, and projected toward the insertion direction corresponding to the indentation.

In another further embodiment according to the present invention, the body of the OBD sensor and the coolant tank are formed as one body, such that the OBD sensor is permanently fixed to the heat dissipation part.

In another further embodiment according to the present invention, the ECU is programmed to execute instructions for a method for diagnosing a malfunction of the system described below.

An exemplary method for diagnosing malfunction of the system according to an embodiment of the present invention includes: outputting a diagnosing signal in an early state of an engine operation; and determining that the air purifier normally operates, if the outputted signal is returned to the ECU via the communication chip.

In a further embodiment according to the present invention, the method further includes determining whether the OBD sensor is maintained to be fixed to the coolant tank, on the basis of a comparison of a temperature of coolant in the coolant tank detected by the thermocouple with a coolant temperature of an engine detected by an engine temperature sensor.

In another further embodiment according to the present invention, said determining whether the OBD sensor is maintained to be fixed to the coolant tank includes: detecting the coolant temperature of the engine and the temperature of coolant in the coolant tank; determining whether a first temperature condition exists, the first temperature condition including that the coolant temperature of the engine is greater than a first predetermined temperature and a difference between the coolant temperature of the engine and the temperature of coolant in the coolant tank is less than a second predetermined temperature; detecting a temperature of coolant in the coolant tank after a predetermined time lapses from a point of detecting the coolant temperature of the engine and the temperature of coolant in the coolant tank, if it is determined that the first temperature condition exists; determining whether a second temperature condition exists, the second temperature condition including that the difference between the coolant temperature of the engine and the temperature of coolant in the coolant tank is less than a third predetermined temperature; and outputting an error diagnosing signal indicating that the OBD sensor is not fixed to the coolant tank, if it is not determined that the second temperature condition exists.

In another further embodiment according to the present invention, said determining whether the OBD sensor is maintained to be fixed to the coolant tank further includes outputting an error diagnosing signal indicating that the OBD sensor is not fixed to the coolant tank, if it is not determined that the first temperature condition exists until the predetermined time.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

An embodiment of the present invention will hereinafter be described in detail with reference to the accompanying drawings.

Figure 1:
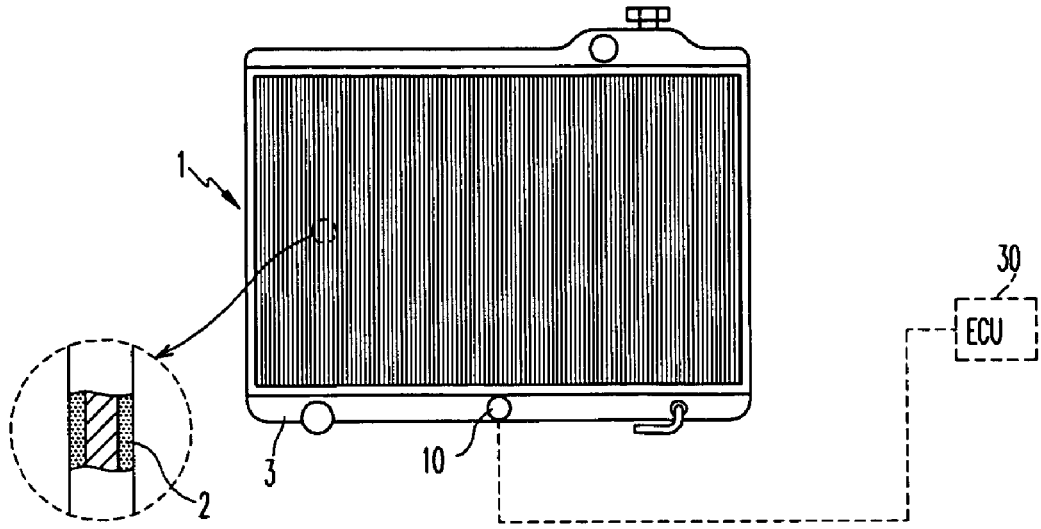
FIG. 1 is a schematic view of an air purifying system according to an embodiment of the present invention.
Figure 2:
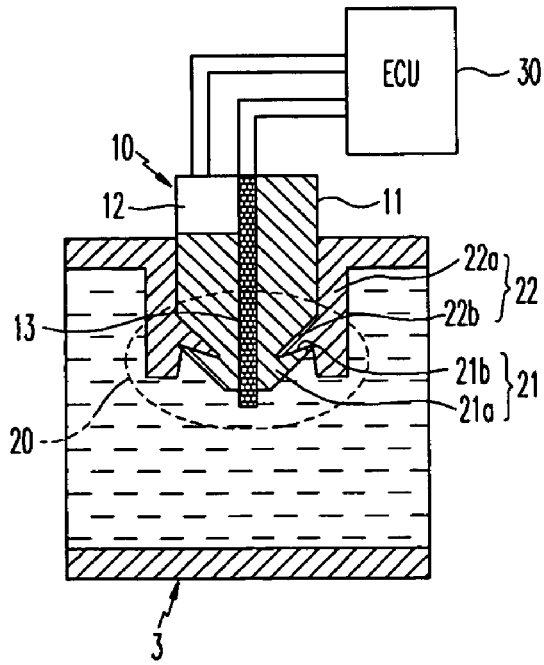
FIG. 2 is a partial cross-sectional view showing a primary part of an air purifying system according to an embodiment of the present invention.

FIG. 1 is a schematic view of an air purifying system according to an embodiment of the present invention, and FIG. 2 is a partial cross-sectional view showing a primary part of an air purifying system according to an embodiment of the present invention.

As shown in FIGS. 1 and 2, an air purifying system according to an embodiment of the present invention includes: a heat dissipation part 1 provided with an air purifier 2, an OBD sensor 10 is permanently fixed to the heat dissipation part 1, and an electronic control unit (ECU) 30 for determining whether the OBD sensor 10 is fixed to the heat dissipation part 1. The heat dissipation part 1 may be a condenser of an air conditioner or a radiator for cooling a vehicle engine. In addition, the air purifier 2 may be an ozonolysis material coated on a radiator or a condenser in order to change ozone of the atmosphere into oxygen. It is preferable that the OBD sensor 10 is fixed to a coolant tank which makes up a bottom portion of the radiator 1, such that the OBD sensor 10 is continuously contacted by a coolant of the radiator 1.

As shown in FIG. 2, the OBD sensor 10 may include: a body 11 permanently fixed to the coolant tank 3; a communication chip 12 incorporated in the body 11 and communicating with the ECU 30 in an early state of an engine operation; and a thermocouple 13 mounted to the body 11 for detecting a temperature of the coolant in the tank 3. In addition, in order for the body 11 of the OBD sensor 10 to be permanently fixed to the coolant tank 3, the air purifying system according to an exemplary embodiment of the present invention may further include a fixing part 20.

As shown in FIG, 2, the fixing part 20 may include: a male connector 21 formed at an outer-circumference of the body 11; and a female connector 22 formed at a predetermined portion of the coolant tank 3 for the male connector 21 to be coupled thereto.

The male connector 21 may include an insert portion 21*a* and an indentation 21*b*. The insert portion 21 a may be tapered toward an insertion direction of the body 11. An indentation 21*b* may be formed at a start point of the insert portion 21*a* and is indented toward the insertion direction.

The female connector 22 may include a guide portion 22*a* and a protrusion 22*b*. The guide portion 22*a* may have a rib defining an insertion hole into which the insert portion 21*a* of the male connector 21 is inserted. The protrusion 22*b* is formed at an inner-circumference of the guide portion 22*a*, and is projected toward the insertion direction corresponding to the indentation 21*b*.

In addition, in order for the body 11 of the OBD sensor 10 to be permanently fixed to the coolant tank 3, as in a further example, the body 11 and the coolant tank 3 may be formed as one body.

The requirements of the air purifying system according to an embodiment of the present invention will hereinafter be described in detail.

It has been certified through experiments that the ozonolysis material 2 has a durability of about 150,000 miles. Accordingly, if it is determined that the coated ozonolysis material 2 is remained on the radiator 1 while a vehicle is traveling until about 150,000 miles, allows the vehicle to be passed by a California Air Resources Board (CARB)

Consequently, to know whether the coated ozonolysis material 2 remains on the radiator 1 while the vehicle is traveling until about 150,000 miles, the air purifying system according to an embodiment of the present invention is required. That is, since a broken radiator (i.e., a radiator including an ozonolysis material that has a life that is expired at 150,000 miles) may be used again after separating the OBD sensor 10 therefrom, the OBD sensor 10 should be permanently mounted to the coolant tank 3 of the radiator 1. Accordingly, the fixing part 20 permanently fixes the OBD sensor 10 to the coolant tank 3.

The ECU 30 can be realized by one or more processors activated by a predetermined program, and the predetermined program can be programmed to perform each step of a method for diagnosing a malfunction of the air purifying system according to an embodiment of this invention.

A method for diagnosing a malfunction of an air purifying system according to an embodiment of the present invention will hereinafter be described in detail with reference to the FIGS. 3 and 4.

Figure 3:
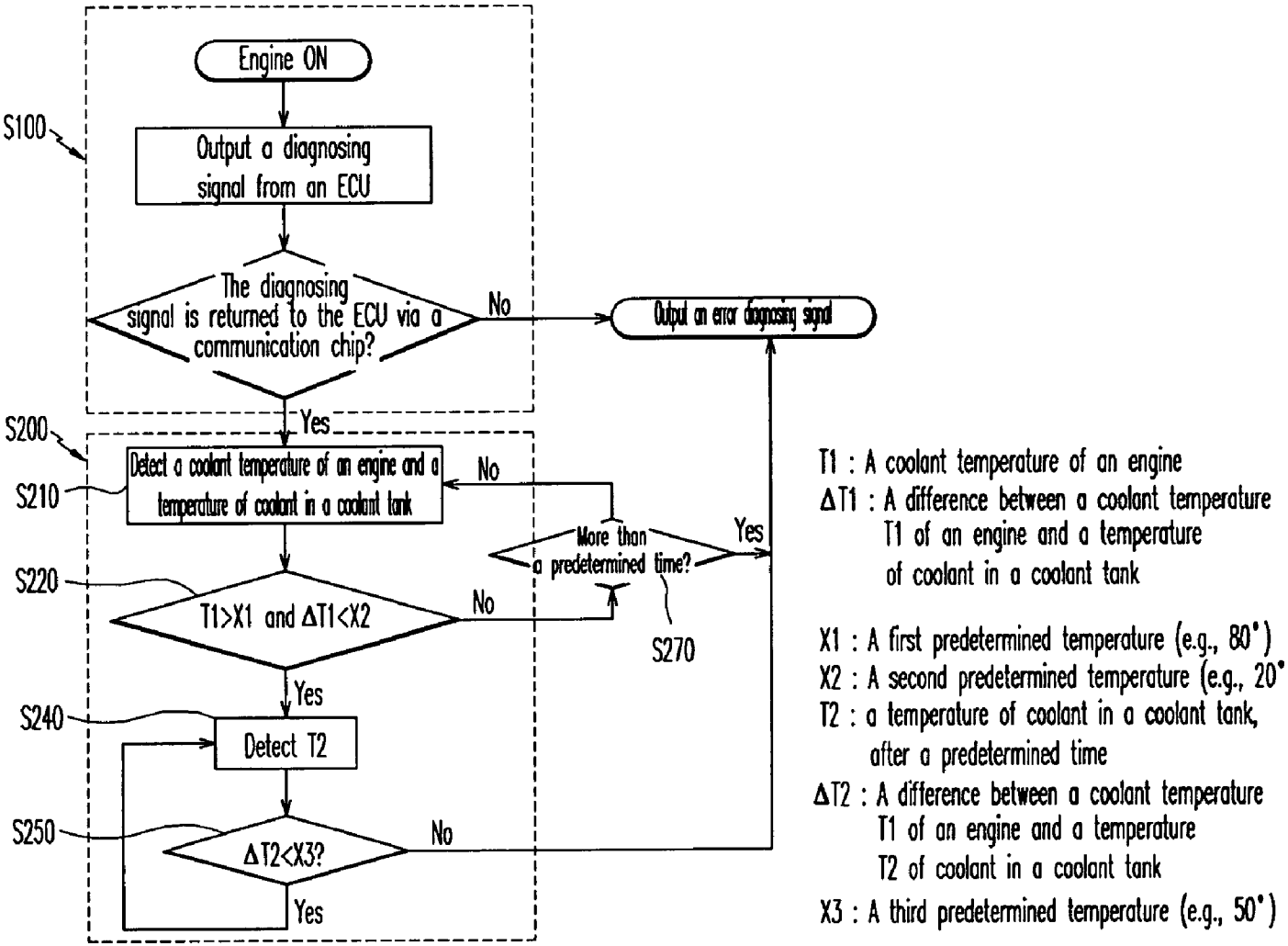
FIG. 3 is a flowchart showing a method for diagnosing malfunction of an air purifying system according to an embodiment of the present invention.
Figure 4:
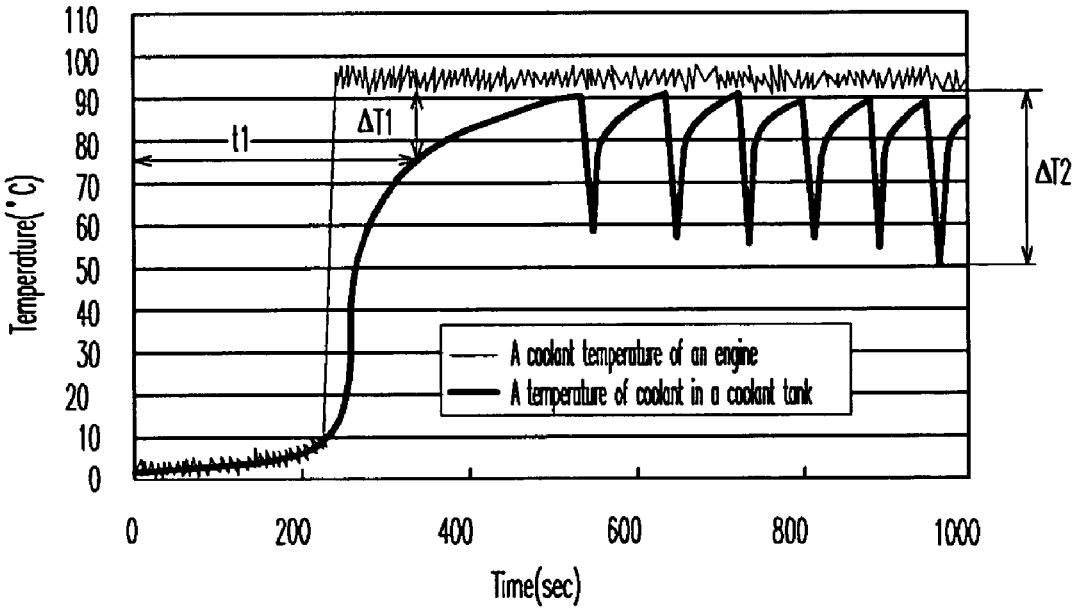
FIG. 4 is a graph showing a temporal correlationship between a coolant temperature of an engine and a temperature of coolant in a coolant tank, in an air purifying system according to an embodiment of the present invention.

FIG. 3 is a flowchart showing a method for diagnosing a malfunction of an air purifying system according to an embodiment of the present invention, and FIG. 4 is a graph showing a temporal correlationship between a coolant temperature of an engine and a temperature of coolant in a coolant tank, in an air purifying system according to an embodiment of the present invention.

Firstly, at step S100, the ECU 30 determines, when a diagnosing signal transmitted therefrom in an early state of engine operation is returned thereto via the communication chip 12, that the air purifier 2 is normally operated. That is, in the early state of engine operation, the ECU 30 outputs a diagnosing signal, and transmits the outputted diagnosing signal to the communication chip 12. The ECU 30 determines whether the transmitted diagnosing signal is returned thereto via the communication chip 12. When the transmitted diagnosing signal is returned thereto, the ECU 30 determines that the air purifier 2 is operating normally.

However, if the diagnosing signal is not returned to the ECU 30, the ECU 30 outputs an error diagnosing signal indicating that air purifier 2 is not operating.

Furthermore, at step S200, the ECU 30 determines whether the OBD sensor 10 is maintained to be fixed to the coolant tank 3, on the basis of a comparison of temperature of coolant in the coolant tank detected by the thermocouple 13 with coolant temperature of the engine detected by a temperature sensor, during engine operation. The step S200 will hereinafter be described in more detail.

At step S210, the ECU 30 recognizes the coolant temperature of the engine detected by the engine temperature sensor, and the temperature of coolant in the coolant tank 3 detected by the thermocouple 13.

At step S220, if the coolant temperature of the engine is denoted as "T1", a difference between the coolant temperature of the engine and the temperature of coolant in the coolant tank 3 as "ΔT1", a first predetermined temperature as "X1 (i.e., about 80°)", and a second predetermined temperature as "X2 (i.e., about 20°)", the ECU 30 determines whether conditions of T1>X1 and ΔT1<X2 are satisfied.

At step S240, the ECU 30 recognizes a temperature T2 of coolant in the coolant tank detected by the thermocouple 13 after a predetermined time lapses from a point of the recognizing the coolant temperature of the engine and the temperature of coolant in the coolant tank, if the conditions of T1>X1 and ΔT1<X2 are satisfied at the step S220.

At step S250, if a difference between the coolant temperature T1 of the engine and the temperature T2 of coolant in the coolant tank 3 is denoted as "ΔT2", and a third predetermined temperature as "X3 (i.e., about 50°)", the ECU 30 determines whether a condition of ΔT2<X3 is satisfied.

The ECU 30 outputs an error diagnosing signal indicating that the OBD sensor 10 is not fixed to the coolant tank 3, when the condition of ΔT2<X3 is not satisfied, at the step S250.

In addition, at step S270, the ECU 30 determines whether the conditions of T1>X1 and ΔT1<X2 are satisfied until the predetermined time.

When the conditions of T1>X1 and ΔT1<X2 are not satisfied until the predetermined time at the step S270, the ECU 30 outputs an error diagnosing signal indicating that the OBD sensor 10 is not fixed to the coolant tank 3.

As has been explained, the air purifying system and the method for diagnosing malfunction thereof according to embodiments of the present invention has the following advantages. According to embodiments of the present invention, it can be known easily and perfectly whether an air purifier is operating normally. In addition, all the advantages described in the specification are inclusive.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An air purifying system, comprising:

a heat dissipation part provided with an air purifier;

an onboard diagnosis sensor (OBD) permanently fixed to the heat dissipation part;

an electronic control unit (ECU) electrically connected with the OBD sensor, in order to determine whether the OBD sensor is fixed to the heat dissipation part.

2. The system of claim 1, wherein the heat dissipation part comprises a radiator cooling an engine of a vehicle.

3. The system of claim 1, wherein the heat dissipation part comprises a condenser for an air conditioner.

4. The system of claim 2, wherein the OBD sensor is fixed to a coolant tank which forms a bottom portion of the radiator.

5. The system of claim 4, wherein the OBD sensor comprises:

a body permanently fixed to the coolant tank;

a communication chip incorporated in the body and communicating with the ECU in an early state of engine operation; and a thermocouple coupled to the body for detecting a temperature of coolant in the coolant tank.

6. The system of claim 5, further comprising a fixing part for permanently fixing the OBD sensor to the heat dissipation part, wherein:

the fixing part comprises:

a male connector formed at an outer-circumference of the body, and a female connector formed at a predetermined portion of the coolant tank in order for the male connector to be coupled thereto;

the male connector comprises:

an insert portion tapered toward an insertion direction of the body, and an indentation formed at a start point of the insert portion and indented toward the insertion direction; and the female connector comprises:

a guide portion having a rib defining an insertion hole into which the insert portion of the male connector is inserted, and a protrusion formed at an inner-circumference of the guide portion and projected toward the insertion direction corresponding to the indentation.

7. The system of claim 5, wherein the body of the OBD sensor and the coolant tank are formed as one body.

8. The system of claim 5, wherein the ECU is programmed to execute instructions for:

outputting a diagnosing signal in an early state of an engine operation; and determining that the air purifier normally operates, if the outputted signal is returned to the ECU via the communication chip.

9. The system of claim 8, wherein the ECU is programmed to execute further instructions for:

determining whether the OBD sensor is maintained to be fixed to the coolant tank, on the basis of a comparison of a temperature of coolant in the coolant tank detected by the thermocouple with a coolant temperature of an engine detected by an engine temperature sensor.

10. The system of claim 9, wherein said determining whether the OBD sensor is maintained to be fixed to the coolant tank comprises:

detecting the coolant temperature of the engine and the temperature of coolant in the coolant tank;

determining whether a first temperature condition exists, the first temperature condition including that the coolant temperature of the engine is greater than a first predetermined temperature and a difference between the coolant temperature of the engine and the temperature of coolant in the coolant tank is less than a second predetermined temperature;

detecting a temperature of coolant in the coolant tank after a predetermined time lapses from a point of detecting the coolant temperature of the engine and the temperature of coolant in the coolant tank, if it is determined that the first temperature condition exists;

determining whether a second temperature condition exists, the second temperature condition including that a difference between the coolant temperature of the engine and the temperature of coolant in the coolant tank is less than a third predetermined temperature; and outputting an error diagnosing signal indicating that the OBD sensor is not fixed to the coolant tank, if it is not determined that the second temperature condition exists.

11. The system of claim 10, wherein said determining whether the OBD sensor is maintained to be fixed to the coolant tank comprises:

outputting an error diagnosing signal indicating that the OBD sensor is not fixed to the coolant tank, if it is not determined that the first temperature condition exists until the predetermined time.

12. A method for diagnosing a malfunction of a system having a radiator provided with an air purifier; an OBD sensor provided to a coolant tank which makes up a bottom portion of the radiator, having a communication chip and a thermocouple; and an electronic control unit (ECU) connected electrically with the OBD sensor in order to determine whether the OBD sensor is fixed to the coolant tank, comprising:

outputting a diagnosing signal from the ECU in an early state of an engine operation; and determining that the air purifier normally operates, if the outputted signal is returned to the ECU via the communication chip.

13. The method of claim 12, further comprising:

determining whether the OBD sensor is maintained to be fixed to the coolant tank, on the basis of a comparison of a temperature of coolant in the coolant tank detected by the thermocouple with a coolant temperature of an engine detected by an engine temperature sensor.

14. The method of claim 13, wherein said determining whether the OBD sensor is maintained to be fixed to the coolant tank comprises:

detecting the coolant temperature of the engine and the temperature of coolant in the coolant tank;

determining whether a first temperature condition exists, the first temperature condition including that the coolant temperature of the engine is greater than a first predetermined temperature and a difference between the coolant temperature of the engine and the temperature of coolant in the coolant tank is less than a second predetermined temperature;

detecting a temperature of coolant in the coolant tank after a predetermined time lapses from a point of detecting the coolant temperature of the engine and the temperature of coolant in the coolant tank, if it is determined that the first temperature condition exists;

determining whether a second temperature condition exists, the second temperature condition including that the difference between the coolant temperature of the engine and the temperature of coolant in the coolant tank is less than a third predetermined temperature; and outputting an error diagnosing signal indicating that the OBD sensor is not fixed to the coolant tank, if it is not determined that the second temperature condition exists.

15. The method of claim 14, wherein said determining whether the OBD sensor is maintained to be fixed to the coolant tank comprises:

outputting an error diagnosing signal indicating that the OBD sensor is not fixed to the coolant tank, if it is not determined that the first temperature condition exists until the predetermined time.

* * * * *